US007345211B2

(12) United States Patent
Espinoza et al.

(10) Patent No.: US 7,345,211 B2
(45) Date of Patent: Mar. 18, 2008

(54) SYNTHETIC HYDROCARBON PRODUCTS

(75) Inventors: Rafael L. Espinoza, Ponca City, OK (US); Keith H. Lawson, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 420 days.

(21) Appl. No.: 10/886,861

(22) Filed: Jul. 8, 2004

(65) Prior Publication Data

US 2006/0006098 A1 Jan. 12, 2006

(51) Int. Cl.
*C10L 1/04* (2006.01)
*C10G 55/04* (2006.01)

(52) U.S. Cl. ..... 585/14; 208/15; 208/950; 208/132; 208/67; 208/89; 208/14

(58) Field of Classification Search ..... 208/15, 208/950, 132, 67, 89, 14; 585/14
See application file for complete search history.

(56) References Cited

U.S. PATENT DOCUMENTS

| | | | | |
|---|---|---|---|---|
| 2,852,456 | A | 9/1958 | Wade | |
| 2,852,546 | A | 9/1958 | Kolling et al. | |
| 3,431,194 | A | 3/1969 | Battok et al. | |
| 4,042,488 | A | 8/1977 | Perciful | 208/102 |
| 4,059,648 | A | 11/1977 | Derr et al. | |
| 4,080,397 | A | 3/1978 | Derr et al. | |
| 4,133,841 | A | 1/1979 | Cosyns et al. | |
| 4,579,986 | A | 4/1986 | Sie | 585/324 |
| 4,832,819 | A | 5/1989 | Hamner | |
| 4,943,670 | A | 7/1990 | Goodall et al. | 585/601 |
| 5,049,536 | A | 9/1991 | Bellussi et al. | 502/235 |
| 5,082,986 | A | 1/1992 | Miller | 585/667 |
| 5,135,638 | A | 8/1992 | Miller | 208/27 |
| 5,146,022 | A | 9/1992 | Buchanan et al. | |
| 5,246,566 | A | 9/1993 | Miller | 208/27 |
| 5,282,958 | A | 2/1994 | Santilli et al. | 208/111 |

(Continued)

FOREIGN PATENT DOCUMENTS

EP 0584879 8/1993

(Continued)

OTHER PUBLICATIONS

PCT International Search Report for Application No. PCT/US05/24394, dated Oct. 5, 2005 ( 3 p.).

*Primary Examiner*—Glenn Caldarola
*Assistant Examiner*—John Douglas
(74) *Attorney, Agent, or Firm*—Conley Rose P.C.

(57) ABSTRACT

The invention includes a process for producing synthetic middle distillates and synthetic middle distillates produced therefrom. In one embodiment, the process comprises fractionating a hydrocarbon synthesis product to at least generate a light middle distillate, a heavy middle distillate, and a waxy fraction; thermally cracking the waxy fraction; and isomerizing the heavy middle distillate. A synthetic diesel or blending component is formed by the combination of at least a portion of the light middle distillate; at least a portion or fraction of the thermally cracked product; and at least a portion or fraction of the isomerized product. In some embodiments, the hydrocarbon synthesis product and/or the thermally cracked product may be hydrotreated. In other embodiments, a synthetic middle distillate comprises at least two fractions: a light fraction with not more than 10% branched hydrocarbons, and a heavy fraction with at least 30% branched hydrocarbons.

57 Claims, 1 Drawing Sheet

U.S. PATENT DOCUMENTS

| | | | | |
|---|---|---|---|---|
| 5,371,308 | A | 12/1994 | Gosselink et al. | |
| 5,378,348 | A * | 1/1995 | Davis et al. | 208/27 |
| 5,689,031 | A | 11/1997 | Berlowitz et al. | |
| 5,723,716 | A | 3/1998 | Brandes et al. | 585/734 |
| 5,766,274 | A | 6/1998 | Wittenbrink et al. | |
| 5,807,413 | A | 9/1998 | Wittenbrink et al. | 44/451 |
| 6,288,296 | B1 | 9/2001 | Miller et al. | |
| 6,296,757 | B1 | 10/2001 | Wittenbrink et al. | |
| 6,497,812 | B1 | 12/2002 | Schinski | |
| 6,703,535 | B2 | 3/2004 | Johnson et al. | 585/303 |
| 2003/0019788 | A1 | 1/2003 | Benazzi et al. | |
| 2003/0199719 | A1 | 10/2003 | Johnson et al. | 585/329 |
| 2004/0159582 | A1 | 8/2004 | Simmons et al. | |

FOREIGN PATENT DOCUMENTS

| | | |
|---|---|---|
| EP | 0 582 347 A1 | 2/1994 |
| EP | 0583836 | 2/1994 |
| EP | 0620264 | 3/1994 |
| EP | 0 668 342 A1 | 8/1995 |
| WO | 96/26993 | 6/1996 |
| WO | 96/13563 | 9/1996 |
| WO | 03/062352 | 7/2003 |

* cited by examiner

SYNTHETIC HYDROCARBON PRODUCTS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates to the field of hydrocarbon production by Fischer-Tropsch synthesis and more specifically to the field of producing a synthetic middle distillate by thermal cracking Fischer-Tropsch wax and isomerizing a Fischer-Tropsch heavy middle distillate.

2. Background of the Invention

Natural gas, found in deposits in the earth, is an abundant energy resource. For example, natural gas commonly serves as a fuel for heating, cooking, and power generation, among other things. The process of obtaining natural gas from an earth formation typically includes drilling a well into the formation. Wells that provide natural gas are often remote from locations with a demand for the consumption of the natural gas.

Thus, natural gas is conventionally transported large distances from the wellhead to commercial destinations in pipelines. This transportation presents technological challenges due in part to the large volume occupied by a gas. Because the volume of a gas is so much greater than the volume of a liquid containing the same number of gas molecules, the process of transporting natural gas typically includes chilling and/or pressurizing the natural gas in order to liquefy it. However, this contributes to the final cost of the natural gas and is not economical for formations containing small amounts of natural gas.

Formations that include small amounts of natural gas may include primarily oil, with the natural gas being a byproduct of oil production that is thus termed associated gas. In the past, associated gas has typically been flared, i.e., burned in the ambient air. However, current environmental concerns and regulations discourage or prohibit this practice.

Further, naturally occurring sources of crude oil used for liquid fuels such as gasoline and middle distillates (such as kerosene, diesel fuel, and home heating oil) have been decreasing, and supplies are not expected to meet demand in the coming years. Middle distillates typically include heating oil, jet fuel, diesel fuel, and kerosene. Fuels that are liquid under standard atmospheric conditions have the advantage that, in addition to their value, they can be transported more easily in a pipeline than natural gas, since they do not require energy, equipment, and expense required for liquefaction.

Thus, for all of the above-described reasons, there has been interest in developing technologies for converting natural gas to more readily transportable liquid fuels, i.e. to fuels that are liquid at standard temperatures and pressures. One method for converting natural gas to liquid fuels involves two sequential chemical transformations. In the first transformation, natural gas or methane, the major chemical component of natural gas, is reacted with oxygen to form syngas, which is a combination of carbon monoxide gas and hydrogen gas. In the second transformation, known as the Fischer-Tropsch process, carbon monoxide and hydrogen are converted into a mixture of organic molecules containing carbon and hydrogen. Those organic molecules containing only carbon and hydrogen are known as hydrocarbons. In addition, other organic molecules containing oxygen in addition to carbon and hydrogen, oxygenates, may be formed during the Fischer-Tropsch process. Hydrocarbons having carbons linked in a straight chain are aliphatic hydrocarbons and may include paraffins and/or olefins. Paraffins are particularly desirable as the basis of synthetic diesel fuel.

Typically, the Fischer-Tropsch product stream contains hydrocarbons having a range of numbers of carbon atoms and thus having a range of molecular weights. Therefore, the Fischer-Tropsch products produced by conversion of natural gas commonly contain a range of hydrocarbons including gases, liquids and waxes. Depending on the molecular weight product distribution, different Fischer-Tropsch product mixtures are ideally suited to different uses. For example, Fischer-Tropsch product mixtures containing liquids may be processed to yield gasoline, as well as middle distillates (such as kerosene, diesel fuel). Hydrocarbon waxes may be subjected to an additional processing step for conversion to liquid and/or gaseous hydrocarbons. Thus, in the production of a Fischer-Tropsch product stream for processing to a fuel, it is desirable to obtain primarily hydrocarbons that are liquids and waxes and that are nongaseous hydrocarbons (e.g., $C_{5+}$ hydrocarbons).

High quality diesel is a desirable product from the Fischer-Tropsch process. The high quality diesel is typically prepared by hydrocracking Fischer-Tropsch wax and blending the hydrocracker product with the diesel range components produced directly in the Fischer-Tropsch process. The hydrocracking reaction is typically accompanied by paraffin hydroisomerization, which typically produces a diesel having improved cold flow properties. However, drawbacks include the diesel having a decreased cetane number. Further drawbacks include the cost accompanied by the catalysts used in the hydrocracking reaction.

Consequently, there is a need for a diesel product in the Fischer-Tropsch process having improved cold flow properties and cetane number. Further needs include reducing the costs of diesel production in the Fischer-Tropsch process.

BRIEF SUMMARY OF SOME OF THE PREFERRED EMBODIMENTS

These and other needs in the art are addressed in one embodiment by a process for producing a synthetic diesel. The process comprises feeding a syngas to a hydrocarbon synthesis reactor, wherein at least a portion of the syngas is reacted to generate a hydrocarbon synthesis product comprising $C_{5+}$ hydrocarbons and hydrotreating a hydrocarbon feed comprising the hydrocarbon synthesis product to provide a hydrotreated hydrocarbon stream. The process further comprises fractionating a fractionator feedstream comprising the hydrotreated hydrocarbon stream to at least produce a light middle distillate, a heavy middle distillate, and a waxy fraction; and thermally cracking at least a portion of the waxy fraction to produce a thermal cracker effluent. In addition, the process further comprises hydrotreating at least a portion or a fraction of the thermal cracker effluent to form a hydrotreated thermally cracked product; and isomerizing at least a portion of the heavy middle distillate to produce an isomerized heavy middle distillate product. In preferred embodiments, the light middle distillate is a light diesel distillate, and the heavy middle distillate is a heavy diesel distillate.

In another embodiment, the invention comprises a process for producing diesel. The process comprises feeding a syngas to a hydrocarbon synthesis reactor, wherein at least a portion of the syngas is reacted to generate a hydrocarbon synthesis product comprising $C_{5+}$ hydrocarbons. The process further comprises providing a fractionator feed comprising the hydrocarbon synthesis product and separating the fractionator feed in a fractionator to produce at least a light diesel distillate, a heavy diesel distillate, and a waxy fraction. In addition, the process comprises cracking in a thermal cracker at least a portion of the waxy fraction to produce the thermally-cracked effluent and optionally, hydrotreating at least a portion of or at least a fraction of the thermally-cracked effluent. Moreover, the process comprises hydrotreating the light diesel distillate to produce a hydrotreated light diesel distillate and optionally, hydroprocessing the heavy diesel distillate. Further, the process comprises isomerizing the heavy diesel distillate to produce an isomerized effluent.

In other embodiments, the hydrocarbon synthesis reactor comprises a Fischer-Tropsch reactor. Further embodiments include hydroprocessing comprising a hydrotreatment step.

A third embodiment of the invention comprises a synthetic middle distillate suitable for use as a liquid fuel or fuel blend comprising primarily about $C_{10}$-$C_{22}$ hydrocarbons, said synthetic middle distillate comprising at least two fractions, a light fraction characterized by a 5% boiling point less than about 360° F. and a 95% boiling point between about 500° F. and 550° F., wherein said light fraction has at least about 90 percent linear hydrocarbons; and a heavy fraction characterized by a 5% boiling point between about 500° F. and 550° F. and a 95% boiling point greater than about 630° F., wherein said heavy fraction has at least about 30 percent branched hydrocarbons.

An additional embodiment of the present invention includes a synthetic middle distillate suitable for use as a fuel or fuel blend. The synthetic middle distillate comprising at least two fractions, a light hydrocarbon fraction comprising between about 25 and about 40 percent by volume of the most volatile hydrocarbons in the synthetic middle distillate, wherein said light fraction comprises less than 10 percent of branched hydrocarbons; and a heavy hydrocarbon fraction comprising between about 10 and about 40 percent by volume of the least volatile hydrocarbons in the synthetic middle distillate, wherein said heavy fraction includes at least about 30 percent branched hydrocarbons.

It will therefore be seen that a technical advantage of the present invention includes thermally cracking heavy bottoms (wax) from the fractionator and isomerizing heavy middle distillates from the fractionator to produce an improved middle distillate product (particularly diesel fuel, and/or jet fuel), thereby overcoming the problems of having a reduced cetane number. Further advantages include a diesel fuel having improved cold flow properties and cetane number. Additional advantages include reduced costs in producing the diesel fuel and/or jet fuel from a Fischer-Tropsch synthesis.

The disclosed devices and methods comprise a combination of features and advantages that enable it to overcome the deficiencies of the prior art devices. The various characteristics described above, as well as other features, will be readily apparent to those skilled in the art upon reading the following detailed description and by referring to the accompanying drawings.

BRIEF DESCRIPTION OF THE DRAWINGS

For a detailed description of the preferred embodiments of the invention, reference will now be made to the accompanying drawings in which.

NOTATION, NOMENCLATURE, AND DEFINITIONS

Figure 1:
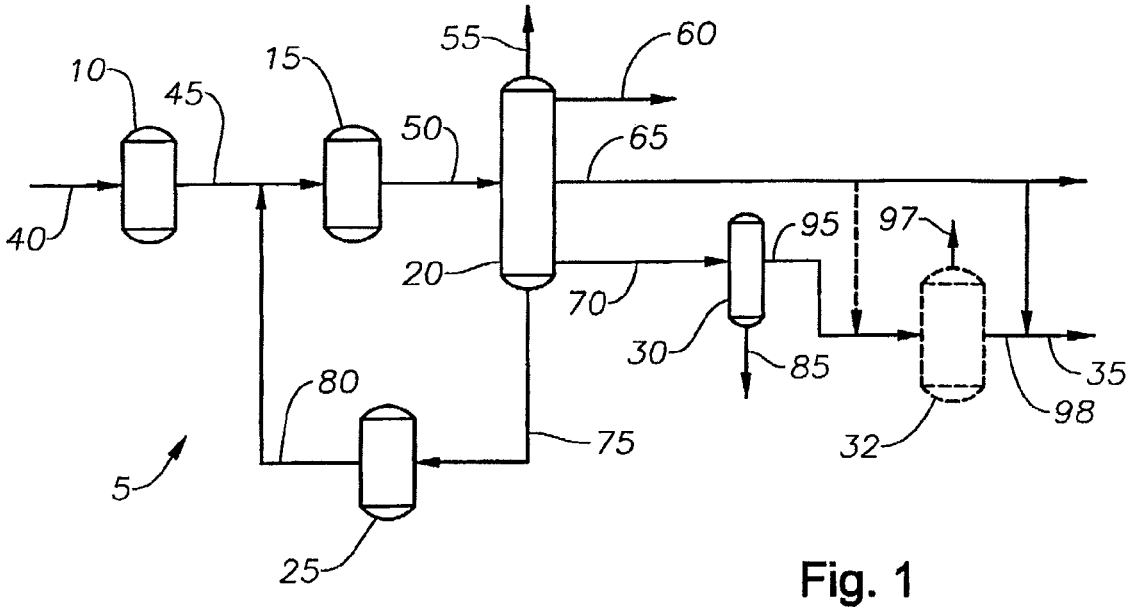
FIG. 1 illustrates a hydrocarbon production process having a thermal cracker.

Certain terms are used throughout the following description and claims to refer to particular system components. As one skilled in the art will appreciate, individuals and companies may refer to a component by different names. This document does not intend to distinguish between components that differ in name but not function. The terms used herein are intended to have their customary and ordinary meaning. The disclosure should not be interpreted as disclaiming any portion of a term's ordinary meaning. Rather, unless specifically stated otherwise, definitions or descriptions disclosed herein are intended to supplement, i.e., be in addition to, the scope of the ordinary and customary meaning of the term or phrase.

As used herein, a "$C_n$" hydrocarbon represents a hydrocarbon with 'n' carbon atoms. Similarly, "$C_{n+}$" hydrocarbons or "$C_{n+}$" hydrocarbonaceous compounds represent hydrocarbons or hydrocarbonaceous compounds with at least 'n' carbon atoms. "$C_{n-}$ hydrocarbons" or "$C_{n-}$" hydrocarbonaceous compounds represent hydrocarbons or hydrocarbonaceous compounds with less than 'n' carbon atoms.

"Heteroatomic compounds" are organic compounds that comprise not only carbon and hydrogen, but also other atoms such as nitrogen, sulfur, and/or oxygen. The non-carbon and non-hydrogen atoms (e.g., oxygen, sulfur and nitrogen, respectively) are "heteroatoms." Examples of heteroatomic compounds comprising oxygen are alcohols, aldehydes, or ketones. Examples of heteroatomic compounds comprising nitrogen are amines. For example, acetone ($CH_3COCH_3$) and dipropyl amine ($(C_3H_7)_2NH$) are heteroatomic compounds.

As used herein, to "hydroprocess" means to treat an organic stream with hydrogen.

As used herein, to "hydrotreat" generally refers to the saturation of double bonds and removal of heteroatoms (oxygen, sulfur, nitrogen) from heteroatomic compounds. To "hydrotreat" means to treat a hydrocarbon stream with hydrogen without making any substantial change to the carbon backbone of the molecules in the hydrocarbon stream. For example, hydrotreating a hydrocarbon stream comprising predominantly an alkene with an unsaturated C=C bond in the alpha position would yield a hydrocarbon stream comprising predominantly the corresponding alkane (e.g., for hydrotreating of alpha-pentene, the ensuing reaction follows: $H_2C{=}CH{-}CH_2{-}CH_2{-}CH_3 + H_2 \rightarrow CH_3{-}CH_2{-}CH_2{-}CH_2{-}CH_3$).

As used herein, to "hydroisomerize" means to convert at least a portion of hydrocarbons to more branched hydrocarbons. An example of hydroisomerization comprises the conversion of linear paraffins into isoparaffins. Another example of hydroisomerization comprises the conversion of mono-branched paraffins into di-branched paraffins.

As used herein, "thermal cracking" generally refers to the breaking down of high molecular weight material into lower molecular weight material by applying heat without the use of a catalyst. There is typically little skeletal isomerization during the thermal cracking step.

As used herein, to "hydrocrack" generally refers to the breaking down of high molecular weight material into lower molecular,weight material in the presence of hydrogen gas and typically in the presence of a catalyst. To "hydrocrack" means to split an organic molecule with hydrogen to the resulting molecular fragments to form two smaller organic molecules (e.g., for hydrocracking of n-decane, the exemplary reaction follows: $C_{10}H_{22}+H_2 \rightarrow C_4H_{10}$ and skeletal isomers+$C_6H_{14}$ and skeletal isomers). Because a hydrocracking catalyst can be active in hydroisomerization, there can be some skeletal isomerization during the hydrocracking step, therefore isomers of the smaller hydrocarbons can be formed.

As used herein, a "diesel" is any hydrocarbon cut having at least a portion that falls within the diesel range. The diesel range in this application includes hydrocarbons that boil in the range of about 300° F. to about 750° F. (about 150 to about 400° C.), preferably in the range of about 350° F. to about 650° F. (about 170 to about 350° C.). The diesel fuel may contain hydrocarbons boiling above or below the diesel fuel range to the extent that such additional hydrocarbons can allow the jet fuel to meet desired diesel fuel specifications.

As used herein, a "jet fuel" is any hydrocarbon cut having at least a portion that falls within the jet fuel range. The jet fuel range includes hydrocarbons that boil in the range of about 250° F. to about 550° F. (about 120 to about 290° C.), preferably in the range of about 250° F. to about 500° F. (about 120 to about 260° C.). The jet fuel may contain hydrocarbons boiling above or below the jet fuel range to the extent that such additional hydrocarbons allow the jet fuel to meet desired jet fuel specifications.

As used herein, a "middle distillate" means a hydrocarbon stream that has a 50 percent boiling point in the ASTM D86 standard distillation test falling between 371° F. and 700° F. Middle distillates include the products commercially known as kerosene, jet fuel, diesel fuel, furnace oil, home heating oil, range oil, stove oil, diesel oil, gas oil, distillate heating oil, engine distillates and Nos. 1, 2, and 3 fuel oils.

As used herein, the term "naphtha" when used in this disclosure refers to a liquid product having between about $C_5$ to about $C_9$ carbon atoms in the backbone and will have a boiling range generally below that of diesel, but wherein the upper end of the boiling range could overlap that of the initial boiling point of diesel.

As used herein, the term "wax" when used in this disclosure refers to a synthetic hydrocarbon wax and is typically obtained as the highest boiling fraction or one of the highest boiling fractions from a Fischer-Tropsch derived product. The synthetic hydrocarbon wax is most often a solid at room temperature. For the purpose of this disclosure, the synthetic hydrocarbon wax contains at least 20% by weight of $C_{20+}$ hydrocarbonaceous compounds with a boiling point typically greater than 650° F.; preferably at least 40% by weight of $C_{20+}$ hydrocarbonaceous compounds, more preferably at least 60% by weight of $C_{20+}$ hydrocarbonaceous compounds, and most preferably at least 80% by weight of $C_{20+}$ hydrocarbonaceous compounds. The synthetic hydrocarbon wax preferably contains a wax product derived from a Fischer-Tropsch process.

As used herein, the boiling range distribution and specific boiling points for a hydrocarbon stream or fraction, typically having a heavier boiling range than a middle distillate boiling range and comprising some waxy hydrocarbons with a boiling point above 700° F., are generally determined by the SimDis method of the American Society for Testing and Materials (ASTM) D2887 *"Boiling Range Distribution of Petroleum Fractions by GC,"* unless otherwise stated. The test method ASTM D2887 is applicable to fractions having a final boiling point of 538° C. (1,000° F.) or lower at atmospheric pressure as measured by this test method. This test method is limited to samples having a boiling range greater than 55° C. (100° F.), and having a vapor pressure sufficiently low to permit sampling at ambient temperature. The ASTM D2887 method typically covers the boiling range of the n-paraffins having a number of carbon atoms between about 5 and 44. Further, it should be understood by those of ordinary skill in the art that a fraction or stream of a particular set of hydrocarbons can exhibit a certain identity. The identity can generally be defined as is defined herein by boiling point ranges. Other characteristics may set apart a particular fraction's identity as may be discussed herein, e.g., carbon number, degree of isomerization, etc.

As used herein, the boiling range distribution and specific boiling points for a hydrocarbon stream or fraction within the middle distillate (i.e., diesel, kerosene, jet fuel, gas oil, heating oil, and the like) boiling range typically comprising substantially no waxy hydrocarbons with a boiling point above 700° F., are generally determined by the ASTM D 86 standard distillation method "*Standard Test Method for Distillation of Petroleum Products at Atmospheric Pressure*," unless otherwise stated.

As used herein, a "portion" of a stream represents a split-stream of said stream, such that the compositions of the portion and the stream are substantially the same.

As used herein, a "fraction" of a stream results from the separation by distillation or fractionation of said stream, such that the compositions of the fraction and the stream are substantially different.

It should be understood by those of ordinary skill in the art that producing a fraction with hydrocarbons comprising definite carbon number cutoffs, e.g., $C_4$-$C_8$ or $C_4$-$C_{11}$, may typically be very difficult and expensive, although not impossible. The reality, especially in industrial settings, is that a distillation process targeting a cutoff of a specified carbon number or temperature may contain a small amount of material above or below the target that becomes entrained into the fraction for various reasons. For example, no two fractions of "diesel" are exactly the same; however, it still is designated and sold as "diesel." It is therefore intended that these explicitly specified fractions or distillates may contain a small amount of other material. The amount outside the targeted range can generally be determined by how much time and expense the user is willing to expend and/or by the limitations of the type of fractionation technique or equipment available.

In addition, where words are used interchangeably, e.g., "fractionated," "distilled," and "separated," it is intended that all sets of terms used interchangeably herein individually can have a broader meaning than their ordinary meaning, one that incorporates the full scope of each interchangeable term. Thus, nothing herein should be interpreted as disclaiming or disavowing of a term's scope unless specifically stated as otherwise.

DETAILED DESCRIPTION OF THE PREFERRED EMBODIMENTS

FIG. 1 illustrates a hydrocarbon production process 5 comprising a hydrocarbon synthesis reactor 10, a hydrotreating unit 15, a fractionator 20, a thermal cracker 25, and an isomerization reactor 30.

Hydrocarbon production process 5 produces a diesel product 35. Diesel product 35 comprises diesel, which comprises mainly $C_{10}$-$C_{23}$ hydrocarbons. Preferably, diesel product 35 comprises mainly $C_{10}$-$C_{23}$ hydrocarbons, more preferably primarily $C_{10}$-$C_{22}$ hydrocarbons. The $C_{10}$-$C_{23}$ or $C_{10}$-$C_{22}$ hydrocarbons preferably comprise linear and branched hydrocarbons, which can be present in any suitable amounts. Preferably, the $C_{10}$-$C_{16}$ (or $C_{10}$-$C_{17}$) hydrocarbons comprise at least about 80 percent linear hydrocarbons, more preferably at least about 90 percent linear hydrocarbons. Still more preferably, the $C_{10}$-$C_{16}$ (or $C_{10}$-$C_{17}$) hydrocarbons further comprise not more than 10% branched hydrocarbons. In other embodiments, the $C_{10}$-$C_{16}$ (or $C_{10}$-$C_{17}$) hydrocarbons comprise at least about 80 percent linear paraffins. In yet other embodiments, the $C_{10}$-$C_{16}$ (or $C_{10}$-$C_{17}$) hydrocarbons comprise at least about 90 percent linear paraffins. The $C_{10}$-$C_{16}$ (or $C_{10}$-$C_{17}$) hydrocarbons can be characterized by a 5% boiling point less than about 360° F. and a 95% boiling point between about 500° F. and 550° F. Preferably, the $C_{17}$-$C_{23}$ (or $C_{17}$-$C_{22}$) hydrocarbons comprise at least about 30 percent isomerized (or branched) hydrocarbons; more preferably at least about 40 percent isomerized (or branched) hydrocarbons. In alternative embodiments, the $C_{17}$-$C_{23}$ (or $C_{17}$-$C_{22}$) hydrocarbons further comprise linear hydrocarbons. In yet alternative embodiments, the $C_{17}$-$C_{23}$ (or $C_{17}$-$C_{22}$) hydrocarbons further comprise linear paraffins. The $C_{17}$-$C_{23}$ (or $C_{17}$-$C_{22}$) hydrocarbons can be characterized by a 5% boiling point between about 500° F. and 550° F. and a 95% boiling point greater than about 630° F.

The following describes an exemplary application of the present invention as illustrated in FIG. 1. A syngas feed 40 is supplied to hydrocarbon synthesis reactor 10. Syngas feed 40 comprises hydrogen, or a hydrogen source, and carbon monoxide. Syngas sources suitable as syngas feed 40 for conversion to hydrocarbons can be obtained from light hydrocarbons, such as methane or hydrocarbons comprised in natural gas, by means of steam reforming, auto-thermal reforming, dry reforming, advanced gas heated reforming, partial oxidation, catalytic partial oxidation, combinations thereof, or other processes known in the art. Alternatively, the syngas source can be obtained from biomass and/or from coal by gasification. In addition, syngas feed 40 can comprise off-gas recycle from the present or another Fischer-Tropsch reactor or process. According to a preferred embodiment, partial oxidation, and particularly catalytic partial oxidation, can be assumed for at least part of the syngas production reaction. The syngas source can contain primarily hydrogen and carbon monoxide; however, many other minor components may be present including steam, nitrogen, carbon dioxide, ammonia, hydrogen cyanide, methane, other light hydrocarbons, and/or oxygen. The syngas source may be used as is or treated to form syngas feed 40. Thus, syngas feed 40 should contain only a low concentration of compounds or elements that have a deleterious effect on the hydrocarbon synthesis catalytic reaction, such as a deactivating or poisoning effect. For example, the syngas source may need to be pretreated to ensure that syngas feed 40 contains low concentrations of sulfur or nitrogen compounds such as hydrogen sulfide, hydrogen cyanide, ammonia and carbonyl sulfides.

Hydrocarbon synthesis reactor 10 comprises any reactor in which hydrocarbons are produced from syngas. Hydrocarbon synthesis reactor 10 comprises preferably a Fischer-Tropsch synthesis, more preferably it comprises at least one Fischer-Tropsch reactor. Preferably, the hydrogen is provided by free hydrogen, although some Fischer-Tropsch catalysts have sufficient water gas shift activity to react some of the CO with water to form $CO_2$ and hydrogen. The formed hydrogen can be reacted in the Fischer-Tropsch synthesis. It is preferred that the molar ratio of hydrogen to carbon monoxide ($H_2$:CO) in syngas feed 40 be greater than 0.5:1 (e.g., from about 0.67 to about 2.5). Preferably, when cobalt, iron, nickel, and/or ruthenium catalysts are used, syngas feed 40 contains hydrogen and carbon monoxide in a molar $H_2$:CO ratio of about 1.4:1 to about 2.3:1, more preferably of about 1.7:1 to about 2.2:1. Syngas feed 40 may also contain carbon dioxide.

Syngas feed 40 is contacted with the catalyst in a reaction zone. Mechanical arrangements of conventional design may be employed as the reaction zone including, for example, fixed bed, fluidized bed, slurry bubble column, slurry phase, slurry bed, or ebullating bed reactors, among others. Accordingly, the preferred size and physical form of the catalyst particles may vary depending on the reactor in which they are to be used.

In a preferred embodiment, hydrocarbon synthesis reactor 10 comprises a hydrocarbon synthesis catalyst. The hydrocarbon synthesis catalyst is preferably a Fischer-Tropsch catalyst. Fischer-Tropsch catalysts are well known in the art and generally comprise a catalytically active metal, optionally a promoter and/or a support structure. The most common catalytic metals present in a Fischer-Tropsch catalyst are selected from Group VIII metals of the Periodic Table (previous IUPAC Notation, as found in, for example, the CRC Handbook of Chemistry and Physics, 82$^{nd}$ Edition, 2001-2002) such as cobalt, nickel, ruthenium, iron, or mixtures thereof The preferred metals used in Fischer-Tropsch catalysts are cobalt, iron and/or ruthenium; however, this invention is not limited to these metals or the Fischer-Tropsch reaction. The promoters and support material are not critical to the present invention and may be comprised, if at all, by any composition known and used in the art. Promoters suitable for Fischer-Tropsch synthesis may comprise at least one element from Groups IA (e.g., lithium, sodium, potassium), VIIA (e.g., manganese, rhenium), VIII (e.g., ruthenium, platinum, palladium), IB (e.g., copper, silver), and IIIB (e.g., boron) of the Periodic Table. When the catalytic metal is cobalt, preferable promoters comprise ruthenium (Ru), platinum (Pt), palladium (Pd), rhenium (Re), boron (B), silver (Ag) or any combination of two of more thereof. When the catalytic metal is iron, preferable promoters are lithium (Li), copper (Cu), potassium (K), silver (Ag), manganese (Mn), sodium (Na), or any combination of two of more thereof. When the catalytic metal is ruthenium, a preferable promoter comprises rhenium (Re). Suitable support materials, when used in the catalyst composition, comprise inorganic oxide supports such as alumina, silica, titania, zirconia, magnesia, or any combination of two of more thereof, such as silica-alumina. In some preferred embodiments, these inorganic oxide supports are stabilized, doped or modified by the use of a structural promoter or stabilizer or chemical modifier or dopant, so as to confer hydrothermal resistance and/or attrition resistance to the support and the catalyst made therefrom.

In a preferred embodiment, hydrocarbon synthesis reactor 10 comprises a Fischer-Tropsch reactor. The hydrocarbon synthesis process can comprise one or more hydrocarbon synthesis reactors 10. When more than one reactor 10 is used, the plurality of reactors 10 can be operated in series and/or in parallel. The Fischer-Tropsch reactor 10 is typically run in a continuous mode. In this mode, the gas hourly space velocity through the reaction zone typically may range from about 50 to about 10,000 $hr^{-1}$, preferably from about 300 $hr^{-1}$ to about 2,000 $hr^{-1}$. The gas hourly space velocity is defined as the volume of gas reactants per time per reaction zone volume, wherein the volume of reactant gases is preferably at standard conditions of pressure (101 kPa) and temperature (0° C.), and further wherein the reaction zone volume is defined by the portion of the reaction vessel volume where the reaction takes place and is typically occupied by a gaseous phase comprising reactants, products and/or unreactive gas (inerts); a liquid phase comprising liquid/wax products and/or other liquids; and a solid phase comprising the catalyst. In a preferred embodiment, the reaction zone includes a slurry, wherein the slurry comprises catalyst particles dispersed in a liquid typically comprising Fischer-Tropsch products, said catalyst dispersion effected by a gas comprising gas reactants bubbling in the liquid. The reaction zone temperature is typically in the range from about 160° C. to about 300° C. Preferably, the reaction zone is operated at conversion promoting conditions at temperatures from about 190° C. to about 260° C., preferably between about 205° C. and about 230° C. The reaction zone pressure is typically in the range of about 80 psia (552 kPa) to about 1,000 psia (6,895 kPa), more preferably from about 80 psia (552 kPa) to about 800 psia (5,515 kPa), and still more preferably from about 140 psia (965 kPa) to about 750 psia (5,170 kPa). Most preferably, the reaction zone pressure is from about 250 psia (1,720 kPa) to about 650 psia (4,480 kPa).

The product of hydrocarbon synthesis reactor 10 is hydrocarbon synthesis product 45, which primarily comprises hydrocarbons of 5 carbon atoms or more. Hydrocarbon synthesis product 45 may also comprise olefins as well as alcohols, aldehydes, and the like. Hydrocarbon synthesis product 45 preferably comprises a hydrocarbon wax. As used herein, a hydrocarbon wax will be taken to mean a product comprising various hydrocarbons that exist as a solid at ambient conditions (room temperature and atmospheric pressure). The hydrocarbon wax preferably comprises hydrocarbons containing at least 20 carbons and greater, hereafter designated $C_{20+}$. The present process can produce a range of hydrocarbons, which can be gaseous, liquid and solid (wax) products at ambient temperature and pressure. The distribution of these products is reflected in the selectivity of the hydrocarbon synthesis reaction, most often characterized by the alpha value ($\alpha$) taken from the Anderson-Schulz-Flory plot, known to those of ordinary skill in the art of Fischer-Tropsch synthesis. A range of hydrocarbons from $C_1$ to $C_{100+}$ may be formed with a selectivity that depends on a. In particular, the selectivity to heavy hydrocarbon products is typically characterized by a high a value. Heavy products with a relatively high selectivity for wax are produced when chain growth probabilities are high. Methane is produced with high selectivity when the chain growth probability is low. In a preferred embodiment of the process, the $C_{10+}$ hydrocarbons in hydrocarbon synthesis product 45 are characterized by an alpha value of at least 0.72, preferably at least 0.85, more preferably at least 0.87, still more preferably between 0.87 and 0.95. In a more preferred embodiment of the process employing cobalt catalyst in hydrocarbon synthesis reactor 10, the $C_{3+}$ hydrocarbons in hydrocarbon synthesis product 45 are characterized by an $\alpha$ value between about 0.85 and about 0.95, preferably between 0.88 and 0.92.

Hydrocarbon synthesis product 45 is fed to hydrotreating unit 15, in which hydrocarbon synthesis product 45 is hydrotreated. Hydrotreating is well known in the art and typically involves treating a hydrocarbon stream with hydrogen without making any substantial change to the carbon backbone of the molecules in the hydrocarbon stream. Hydrotreating preferably converts substantially all alkenes (also called olefins) to paraffins. Olefins are known to cause chemical instability in diesel fuel. This instability frequently manifests itself in the formation of gums, which may form solid deposits in the fuel system and engine. This instability is typically measured by the oxidation stability ASTM D2274 test. Traditional hydrotreatment also removes heteroatoms in heteroatomic compounds such as sulfur-containing compounds (such as thiols, thiophenes, benzothiophenes, and the like); nitrogen-containing compounds (such as amines, ammonia); and oxygenated hydrocarbons also called oxygenates (such as alcohols, aldehydes, esters, ketones, and the like).

Since it is expected that the hydrocarbon synthesis product 45 comprises a majority of Fischer-Tropsch (unsaturated and saturated) $C_{5+}$ hydrocarbon products, hydrocarbon synthesis product 45 can further comprise some oxygenates, but should have very low sulfur and nitrogen contents. The hydrotreating conditions of hydrotreating unit 15 can be selected so as to convert substantially all of the unsaturated hydrocarbons to saturated hydrocarbons and to remove some or substantially all of the oxygenates during the hydrotreatment of hydrocarbon synthesis product 45. In some embodiments, the hydrotreatment step converts oxygenates present in hydrocarbon synthesis product 45 to saturated hydrocarbons but in alternate embodiments, the conditions in the hydrotreatment step allows a substantial amount of the oxygenates to remain unconverted. The hydrotreatment typically takes place over hydrotreating catalysts at temperatures from about 80° C. to about 400° C. (about 175 to about 750° F.). The hydrotreating catalysts can comprise a Group VIA metal, for example molybdenum (Mo) and/or tungsten (W); a Group VIII metal, for example nickel (Ni), palladium (Pd), platinum (Pt), ruthenium (Ru), iron (Fe), and/or cobalt (Co); or any combination of two or more thereof. The nickel, palladium, platinum, tungsten, molybdenum, ruthenium, and any combination of two or more thereof are typically highly active catalysts, and the iron and cobalt are typically less active catalysts.

A mild hydrotreating step may be performed over a hydrotreating catalyst comprising at least one metal selected from the group consisting of Ni, Pd, Pt, Mo, W, and Ru, preferably comprising Ni, Co, Mo, W or any combination of two or more thereof, more preferably comprising Ni. Such mild hydrotreating step can be performed under mild conditions at temperatures above 350° F. (170° C.), preferably from 350° F. (170° C.) to about 750° F. (400° C.), more preferably from 360° F. (180° C.) to about 750° F. (400° C.), with a hydrogen partial pressure in the hydrotreater outlet between about 100 psia and about 2,000 psia (about 690-13,800 kPa). A mild hydrotreatment can have the benefits of converting substantially all unsaturated hydrocarbons to saturated hydrocarbons, removing a substantial portion (>90%) or all of the heteroatoms from the hydrocarbon stream, and optionally, capturing most of the solid material.

In one alternate embodiment for the hydrotreating step, an "ultra-low severity hydrotreatment" step may be used to retain some of the oxygenates present in the hydrocarbon stream comprising primarily Fischer-Tropsch $C_{5+}$ hydrocarbon products, while removing the olefins in the hydrocarbon stream. Oxygenates (particularly alcohols) derived from Fischer-Tropsch synthesis have been shown to advantageously increase the lubricity of the diesel product provided by the Fischer-Tropsch synthesis. Others have reported methods to maintain the oxygenates in the diesel fraction of a FT product stream by not hydrotreating a portion of the diesel fraction directly provided by the Fischer-Tropsch synthesis in order to retain oxygenates, but the non-hydrotreated portion may result in leaving olefins in the diesel product.

Applicants believe that an "ultra-low severity" hydrotreatment step of the hydrocarbon stream comprising primarily Fischer-Tropsch $C_{5+}$ hydrocarbon products is highly desirable to retain some oxygenates in at least one of the resulting diesel fractions obtained thereafter, and it is expected that the remaining oxygenates can increase the lubricity of that resulting diesel fraction. Two important factors in determining whether a hydrotreating process does not convert a substantial amount of oxygenates to paraffins are catalyst composition and temperature. "Ultra-low severity" hydrotreating can take place with hydrotreating catalysts comprising at least one of the following metals: a metal from Group VI (previous IUPAC notation), such as molybdenum (Mo) and tungsten (W); or a metal from Group VIII, such as nickel (Ni), palladium (Pd), platinum (Pt), ruthenium (Ru), iron (Fe), and/or cobalt (Co); or any combination of two or more thereof. Highly active catalysts, such as those comprising Ni, Pd, Pt, W, Mo, Ru or any combination of two or more thereof, can be operated at relatively low temperatures (to maintain "ultra-low severity" hydrotreating conditions) between about 180° F. and about 480° F. (about 80° C. and about 250° C.), more preferably between about 180° F. and about 350° F. (about 80° C. and about 180° C.), still more preferably between about 180° F. and about 300° F. (about 80° C. and about 150° C.). By way of example only, a highly active catalyst such as a nickel-based catalyst begins to convert a substantial amount of oxygenates at about 250° F. (about 121° C.). In contrast, less active catalysts such as those comprising Fe or Co do not begin to convert a substantial amount of the oxygenates until a temperature of about 350° F. (about 180° C.) is reached. For these catalysts with lower hydrotreating activity (e.g., Co or Fe), a preferred temperature range for "ultra-low severity" hydrotreating is between about 350° F. and about 570° F. (about 180° C. and about 300° C.). Additionally, there are other parameters such as for example, pressure and liquid hourly space velocity, which may be varied by one of ordinary skill in the art to affect the desired "ultra-low severity" hydrotreating. Preferably, the hydrogen partial pressure is between about 100 psia and about 1,000 psia (about 690-6,900 kPa), more preferably between about 300 psia and about 500 psia (about 2,000-3,500 kPa). The liquid hourly space velocity is preferably between 1 and 10 $hr^{-1}$, more preferably between 0.5 and 6 $hr^{-4}$, still more preferably between about 1 and about 5 $hr^{-1}$It should be understood that the hydrotreating catalyst for "ultra-low severity" hydrotreatment can be with or without support, although it is preferably supported and can comprise promoters to improve catalyst performance and/or support structural integrity.

Hydrotreated product stream 50 leaves hydrotreating unit 15 and is fed to fractionator 20 where it is separated into distillation cuts, which include a light fraction 55; a naphtha 60; a light diesel 65; a heavy diesel 70; and a waxy fraction 75. It is to be understood that the present invention is not limited to forming distillates 60, 65, and 70 but can comprise forming more or less distillates. For instance, other distillates can also include jet fuel, heating oil, and kerosene.

Methods of fractionation are well known in the art, and hydrotreated product stream 50 can be fractionated by any suitable fractionation method. Fractionator 20 preferably comprises an atmospheric distillation column and optionally may further comprise a vacuum distillation column or a short-path distillation unit. The use of a vacuum or short-path distillation unit, in addition to the atmospheric distillation column for the fractionator 20, allows the generation of different waxy cuts of various boiling ranges, by feeding the bottoms of the atmospheric distillation column to the vacuum or short-path distillation unit to obtain at least two wax cuts, such as a light wax cut and a heavy wax cut. Waxy fraction 75 feeding thermal cracker 25 can comprise the bottoms of an atmospheric distillation column fed that is fed by hydrotreated product stream 50; a light wax cut or a heavy wax cut (such as vacuum bottoms) from a vacuum distillation column; or any combination thereof. Hence, in general terms, waxy fraction 75 refers to a higher boiling fraction than heavy diesel distillate 70. In some embodiments, waxy fraction 75 contains at least 30% by weight of $C_{20+}$ hydrocarbonaceous compounds, preferably at least 50% by weight of $C_{20+}$ hydrocarbonaceous compounds, more preferably at least 70% by weight of $C_{20+}$ hydrocarbonaceous compounds. In preferred embodiments, waxy fraction 75 contains at least 90% by weight of $C_{20+}$ hydrocarbonaceous compounds. In alternate embodiments, waxy fraction 75 contains at least 10% by weight of $C_{30+}$ hydrocarbonaceous compounds, preferably at least 20% by weight of $C_{30+}$ hydrocarbonaceous compounds. In yet other embodiments, waxy fraction 75 contains at least 10% by weight of $C_{40+}$ hydrocarbonaceous compounds, preferably at least 20% by weight of $C_{40+}$ hydrocarbonaceous compounds. Waxy fraction 75 preferably comprises the bottoms of an atmospheric distillation tower in fractionator 20.

Light fraction 55 typically comprises hydrocarbon products normally in the gaseous phase at ambient temperature and referred to as $C_{5-}$ hydrocarbons. Light diesel 65 and heavy diesel 70 comprise primarily a diesel cut, with light diesel 65 comprising lighter hydrocarbons (i.e., with a lower boiling range) than heavy diesel 70. Light diesel 65 can have a boiling range generally below that of heavy diesel 70, but wherein the upper end of the boiling range of light diesel 65 can overlap that of the initial boiling point of heavy diesel 70. Preferably, light diesel 65 comprises mainly $C_{10}$-$C_{16}$ hydrocarbons. Preferably, at least a portion of light diesel 65 comprises linear hydrocarbons. More preferably, light diesel 65 comprises at least about 80 percent linear hydrocarbons; still more preferably at least about 90 percent linear hydrocarbons; most preferably at least about 93 percent linear hydrocarbons. Preferably, heavy diesel 70 comprises mainly $C_{17}$-$C_{23}$ hydrocarbons. Heavy diesel 70 can have a boiling range generally below that of waxy fraction 75. In some embodiments, the upper end of the boiling range of heavy diesel 70 can overlap that of the initial boiling point of waxy fraction 75, while in alternate embodiments, the upper end of the boiling range of heavy diesel 70 and the initial boiling point of waxy fraction 75 do not overlap. Preferably, at least a portion of heavy diesel 70 comprises linear hydrocarbons. More preferably, heavy diesel 70 comprises at least about 85 percent linear hydrocarbons; still more preferably at least about 90 percent linear hydrocarbons; still most preferably at least about 93 percent linear hydrocarbons. Still more preferably, light diesel 65 and heavy diesel distillate 70 comprise mostly normal paraffins (i.e., more than 70% paraffins), have a high cetane number (i.e., greater than 70), may have some oxygenates derived from FT synthesis (for instance, if an "ultra-low severity" hydrotreating step is used in hydrotreater 15) to obtain an acceptable lubricity, and have a very low content of branched hydrocarbons. In preferred embodiments, light diesel 65 has a very low content in branched hydrocarbons (i.e., less than 10 wt % branched hydrocarbons) or substantially free of branched hydrocarbons (i.e., less than 5 wt % branched hydrocarbons). In some embodiments, light diesel 65 and heavy diesel 70 comprise at least 90 percent normal paraffins. Light diesel 65 is preferably characterized by a 5% boiling point less than about 360° F. and a 95% boiling point between about 500° F. and about 550° F. Heavy diesel 70 is preferably characterized by a 5% boiling point between about 500° F. and 550° F. and a 95% boiling point greater than about 630° F.

Waxy fraction 75 is fed to thermal cracker 25, in which at least a portion of waxy fraction 75 is thermally cracked. Waxy fraction 75 can be cracked to produce any desired hydrocarbon, preferably linear hydrocarbons. Preferably, substantially all of waxy fraction 75 is fed to thermal cracker 25. A purge (not shown in FIG. 1) taken from waxy fraction 75 may be performed in order to remove some material resilient to the thermal cracking. The purge stream typically represents not more than about 2 percent by volume of fraction 75, preferably less than about 1 percent by volume of fraction 75. The small purge stream from waxy fraction 75 may be necessary to prevent the accumulation of small amount of solids (such as catalyst particles or subparticles).

Thermal cracking of hydrocarbons is well known in the art, and thermal cracking of waxy fraction 75 to primarily linear hydrocarbons can be accomplished by any suitable thermal cracking process. Thermal cracking basically aims at the reduction of molecular size by application of heat without addition of catalyst or hydrogen. Long chain paraffinic hydrocarbon molecules break down into a number of smaller ones by rupture of a carbon-to-carbon bond (the smaller molecules so formed may break down further). When this occurs, the number of hydrogen atoms present in the parent molecule can be insufficient to provide the full complement for each carbon atom, so that a majority of olefins or "unsaturated" compounds are typically formed. Without limiting the present invention, it is assumed that the rupturing can take place in many ways, and a free radical mechanism for the bond rupture is generally assumed. At a temperature level of 350-500° C., the larger hydrocarbon molecules become unstable and tend to break spontaneously into smaller molecules. By varying the time, temperature and pressure under which a particular feedstock remains under cracking conditions, the desired degree of cracking (conversion) can be controlled. Temperature and residence time are important process variables, while pressure plays a secondary role. The cracking conditions to be applied and the amount and type of cracked products can depend largely on the type of feedstock.

In some embodiments, thermal cracker 25 comprises a furnace and a reaction chamber (not shown). For example, waxy fraction 75, after appropriate preheat, is sent to the furnace for heating to the cracking temperature selected from about 380° C. to 700° C., preferably from about 380° C. to 550° C. The cracking takes place to a small extent in the furnace and largely in the reaction chamber located just downstream of the furnace. At the reaction chamber outlet, the temperature is lower than at the furnace outlet (i.e., reaction chamber inlet) because the cracking reactions are endothermic. An up-flow reaction chamber provides for a prolonged residence time and therefore permits a lower cracking temperature than if the reaction chamber is not used. Advantages include cost in furnace and fuel. Modern reaction chambers for thermal cracking are equipped with internals so as to reduce backmixing effects, thus maximizing the viscosity reduction. Since only one cracking stage is involved, this layout is also named one-stage cracking. The preferred cracking temperature applied is about 380-700° C., more preferably about 380-550° C.; and at a pressure of about 500-1,100 kPa (about 60-150 psig). More severe conditions are necessary when the feedstock (waxy fraction 75) to the thermal cracker 25 has a smaller molecular size and is therefore more difficult to crack than larger hydrocarbon molecules. Thermal cracker effluent 80 is quenched at the reaction chamber outlet to stop the cracking reaction (to prevent excessive coke formation). The quenching can be accomplished by indirect heat transfer (for example, by a heat exchanger with water as cooling medium) or by diluting the thermal cracker effluent 80 with a cooler stream. A suitable cooler stream may be hydrocarbon synthesis product 45. Other suitable thermal cracking of waxy fractions (i.e., without hydrogen and catalyst) are disclosed in for instance, U.S. Pat. Nos. 4,579,986; 4,042,488 and 6,703,535, each of which is hereby incorporated by reference in its entirety to the extent that they do not conflict with the teachings of the present application. Water (or steam) can be fed to thermal cracker 25 and used during thermal cracking to provide heat to the endothermic cracking reaction and/or to prevent coke formation. The steam addition is disclosed in U.S. Pat. Nos. 4,579,986; 4,042,488 and 6,703,535. However, it is preferred by the Applicants that some steam such as less than 40% by weight of the overall load of the thermal cracker 25, preferably less than 30% by weight, more preferably less than 20% by weight is fed to thermal cracker 25. In some embodiments, less than 10% of the overall load of thermal cracker 25 comprises steam. Steam is usually added to heat the hydrocarbon feedstock to the thermal cracker (i.e., waxy fraction 75) as well as to prevent coking. Fired heaters (instead of steam) are the preferable heat source for thermal cracker 25. In performing the thermal cracking operation, the waxy fraction 75 can be partially or totally vaporized during pre-heating. Hence, pre-heated feed (waxy fraction 75) can be maintained during the cracking operation in a mixed liquid/vapor phase or a vapor phase.

Thermal cracker 25 can be operated at any suitable conditions. The optimal temperature and other conditions in the thermal cracking zone for the cracking operation can vary somewhat depending on the composition of the feed and its boiling range. In general, the temperature is high enough to maintain at least a portion of the feed in the vapor phase but not so high that the feed is overcracked, i.e., the temperature and conditions are not so severe that excessive $C_{5-}$ hydrocarbons are generated. Without limiting the invention, thermal cracker 25 preferably operates at temperatures between about 380° C. and about 700° C., preferably between about 380° C. and about 550° C. and at pressures between about 500 kPa and about 2,000 kPa. The optimal temperature range for thermal cracker 25 in order to maximize the production of smaller hydrocarbons from the Fischer-Tropsch wax will depend upon the endpoint of the feed (waxy fraction 75). In general, the higher the carbon number, the higher the temperature required to achieve maximum conversion. Maximum conversion may be obtained to the detriment of desired product selectivity (i.e., middle distillate such as diesel or jet fuel). Hence, a desired conversion in thermal cracker 25 is between 10% and 70%; preferably between 12% and 65%; more preferably between 15% and 60%. Although the optimal residence time of waxy fraction 75 in thermal cracker 25 can vary depending on the temperature and pressure in the reaction zone, typical residence times are generally in the range of from about 0.5 seconds to about 500 seconds, with the preferred range being between about 2.5 seconds and about 300 seconds; with the more preferred range being between about 10 seconds and about 250 seconds; with the most preferred range being between about 20 seconds and about 200 seconds. Accordingly, some routine experimentation may be necessary to identify the optimal cracking conditions for a specific feed.

At least a portion of thermal cracker effluent 80 is fed to hydrotreating unit 15 wherein the portion of thermal cracker effluent 80 is hydrotreated with hydrogen gas over a hydrotreating catalyst so as to convert some or preferably most of the unsaturated hydrocarbonaceous compounds (formed during thermal cracking) to paraffins. FIG. 1 shows that thermal cracker effluent 80 is combined with hydrocarbon synthesis product 45 before entering hydrotreating unit 15. In alternate embodiments, thermal cracker effluent 80 and hydrocarbon synthesis product 45 are fed separately to hydrotreating unit 15. In yet other embodiments, a portion of thermal cracker effluent 80 is combined with hydrocarbon synthesis product 45 to form the feed to hydrotreating unit 15. Alternatively, although not illustrated, at least a portion or substantially all of thermal cracker effluent 80 is fed to a second hydrotreating unit (not shown), which is different than hydrotreating unit 15. The hydrotreated effluent from said second hydrotreating unit can be sent to fractionator 20 or to a different fractionator (not shown). An advantage of this alternate embodiment is the ability of using different hydrotreating conditions (such as catalyst composition, temperature, pressure, hydrogen-to-hydrocarbon feed ratio) in the second hydrotreating unit in order to accommodate a larger proportion of olefins in thermal cracker effluent 80. Any portion of thermal cracker effluent 80, which is not hydrotreated, comprises a significant proportion of olefins and, instead of being fed to fractionator 20, can be used as a chemical feedstock for further conversion to useful products such as polyolefins, plastics, ethylene oxide, ethylene glycol and the like. Preferably, substantially all of thermal cracker effluent 80 is fed to hydrotreating unit 15. In this preferred embodiment, the recycle of thermal cracker effluent 80 to ultimately fractionator 20 (via hydrotreating unit 15) can assure that substantially all of the wax hydrocarbons are recycled to extinction in hydrocarbon production process 5.

Heavy diesel 70 is fed to isomerization reactor 30 for hydroisomerization to obtain isomers of linear hydrocarbons comprised in heavy diesel 70. Heavy diesel 70 can be isomerized for various purposes, preferably to increase the degree of branching of the hydrocarbons comprised in heavy diesel 70, which can improve at least one of the cold flow properties of diesel (i.e., pour point such as measured by ASTM D97, cloud point such as measured by ATSM D2500, or cold filter plugging point such as defined by ASTM D6371-99). The pour point is typically the lowest temperature at which a fuel can be handled without excessive amounts of wax crystals forming so as to prevent flow. If a fuel temperature is below the pour point, wax will begin to separate out, which can block filters. The pour point is generally increased by a high paraffin content. Isoparaffins are known to reduce the pour point of highly paraffinic hydrocarbon mixtures.

Isomerization of hydrocarbons is well known in the art, and heavy diesel 70 can be hydroisomerized by any suitable technique to provide branching in order to lower the pour point, and thus improve the cold flow properties and/or for any other purpose.

Hydroisomerization typically involves passing heavy diesel 70 and hydrogen over a hydroisomerization catalyst so as to convert at least a portion of the normal paraffins (and, if any, slightly branched iso-paraffins) in the feed to branched paraffins; and thereby generate a product stream with a greater content in branched hydrocarbons (i.e., with a higher iso-to-normal paraffin ratio than that of the hydrocarbon feed to the isomerization). Typical conditions for hydroisomerization involve temperatures from about 180° C. to 380° C., pressures from about 1,100 kPa to about 15,000 kPa (about 150-2,200 psig), and space velocities from about 0.1 to about 5 $hr^{-1}$. Catalysts for hydroisomerization are generally dual-functional catalysts consisting of an acidic component and a metal component. Both components are required to conduct the isomerization reaction. Typical metal components are nickel, molybdenum, tungsten, platinum, palladium, or any combination of two or more thereof, with platinum most commonly used. The choice and the amount of metal in the catalyst can be sufficient to achieve greater than 10 percent isomerized hexadecane products in the test described in U.S. Pat. No. 5,282,958. The acidic catalyst components useful for the hydroisomerization include amorphous silica-alumina, fluorided alumina, molecular sieves (i.e., ZSM-12, ZSM-21, ZSM-22, ZSM-23, ZSM-35, ZSM-38, ZSM-48, ZSM-57, SSZ-32, SAPO-11, SAPO-31, SAPO-41, MAPO-11, MAPO-31, Y zeolite, L zeolite, and beta zeolite), and any combination of two or more thereof.

U.S. Pat. Nos. 5,135,638; 5,246,566; 5,282,958; 5,082,986; 5,723,716; 5,049,536; 4,943,672; and European Patent Nos. EP 0 582 347 and EP 0 668 342; as well as PCT Published Patent Application Nos. WO 96/26993 and PCT WO 96/13563 are hereby incorporated by reference in their entirety to the extent that they do not conflict with the teachings of the present application. Such patents and patent applications teach suitable isomerization techniques, representative process conditions, yields, and product properties.

Isomerization reactor 30 can be operated at any conditions suitable for the desired hydroisomerization. Preferably, isomerization reactor 30 is operated at temperatures from about 180° C. to about 380° C., at pressures from about 1,100 kPa to about 15,000 kPa (about 150-2,200 psig), and space velocities from about 0.1 $hr^{-1}$ to 5 $hr^{-1}$. Isomerized heavy diesel product 95 comprises the hydroisomerized heavy diesel 70. Any portion of isomerized heavy diesel product 95 can comprise isomerized hydrocarbons, preferably isomerized heavy diesel 70 comprises at least about 30 percent isomerized (or branched) hydrocarbons, more preferably at least about 40 percent isomerized (or branched) hydrocarbons.

Diesel product 35 can be formed by using at least a portion of isomerized heavy diesel product 95 "as is." In alternative embodiments, since hydroisomerization in isomerization reactor 30 also can result in some hydrocracking of hydrocarbons and thus can generate some light hydrocarbons with a number of carbon atoms equal to or less than 9 ($C_{9-}$), isomerized heavy diesel product 95 can be fed to a secondary fractionator 32 so as to remove those produced light hydrocarbons from the diesel-range product, i.e., to form at least one light fraction 97 comprising mainly $C_{9-}$ hydrocarbons, and flashed isomerized heavy diesel product 98 comprising primarily $C_{10}$-$C_{25}$ with at least 30 percent of the $C_{18}$-$C_{25}$ hydrocarbons being branched. This fractionation of isomerized heavy diesel product 95 is considered optional, but is preferred when the flash point of diesel product 35 does not meet the minimum required specification for diesel. The need of this secondary fractionation can be dependent on the conditions and catalyst selected for isomerization reactor 30. High temperature, high pressure and/or high acidity of the catalyst may increase the "severity" of the treatment and therefore may enhance the hydrocracking reaction, thereby creating more light hydrocarbons and most likely necessitating removing these formed light hydrocarbons from isomerized heavy diesel product 95 before being blended with at least a portion of light diesel 65 to form diesel product 35.

In some embodiments, isomerized heavy diesel product 95 can be combined with light diesel distillate 65 to form diesel product 35. Preferably, diesel product 35 comprises a combination of at least a portion of flashed isomerized heavy diesel product 98 and at least a portion of light diesel 65. In alternate embodiments, diesel product 35 comprises a combination of at least a portion of the isomerized heavy diesel product and at least a portion of light diesel 65. The proportions of light diesel distillate 65 and flashed isomerized heavy diesel product 98 (or of light diesel 65 and isomerized heavy diesel 95) in diesel product 35 depend on the desired cold-flow properties of the diesel product 35. For example, in winter months, it is desirable to decrease, for example, the pour point of diesel product 35 (i.e., increase the fraction of isomerized heavy diesel product in diesel product 35) in areas where the outside temperature is significantly low (below 0° F., or even lower than −20° F. in some areas) so as to potentially cause wax crystallization in diesel product 35. Hence, the fraction of the isomerized heavy diesel (95 or 98) in diesel product 35 can be greater in the winter months than in the summer months. In alternative embodiments (not illustrated), diesel product 35 comprises isomerized heavy diesel product 95, flashed isomerized heavy diesel product 98, or light diesel 65. In alternative embodiments, diesel product 35 comprises a combination of at least a portion of isomerized heavy diesel product 95, at least a portion of flashed isomerized heavy diesel product 98, and at least a portion of light diesel 65.

Naphtha 60 can comprise at least about $C_6$ to $C_9$ hydrocarbons. In preferred embodiments, naphtha 60 comprises about $C_5$ to $C_9$ hydrocarbons. In some embodiments, naphtha 60 comprises about $C_6$ to $C_{10}$ hydrocarbons; alternatively about $C_5$ to $C_{10}$ hydrocarbons, or about $C_5$ to $C_{11}$ hydrocarbons, or about $C_6$ to $C_{11}$ hydrocarbons, depending on the boiling point cutoff selected between naphtha and diesel. Naphtha 60 comprises primarily linear hydrocarbons. Preferably, 80 percent of naphtha 60 is linear hydrocarbons. More preferably, 90 percent of naphtha 60 is linear hydrocarbons. Naphtha 60 can be characterized by a 5% boiling point between about 70° F. and 90° F. and a 95% boiling point less than about 350° F. The linear hydrocarbons can include normal alkanes, normal alkenes, or mixtures thereof. Naphtha 60 preferably comprises mainly saturated hydrocarbons (paraffins) and comprises only small amounts of olefins. In some embodiments, naphtha 60 comprises at least about 80 percent normal alkanes. Such linear naphtha stream is desirable for downstream uses such as steam cracker feed for the production of olefins (i.e., propylene, ethylene), as a source of solvents, and the like. It is also envisioned that at least a portion (or substantially all of) one light fraction comprising mainly $C_5$-$C_8$ hydrocarbons obtained from the optional second fractionator 32 located downstream to isomerization reactor 30 may be combined with naphtha 60. This light fraction comprising mainly $C_5$-$C_8$ hydrocarbons obtained from the optional second fractionator 32, post-isomerization, may have some isomerized light hydrocarbons, and its addition to naphtha 60 can thus increase the degree of isomerization of the resulting naphtha blend.

Although not illustrated in FIG. 1, a portion of isomerized heavy diesel product 95 can be recycled to isomerization reactor 30. Alternatively, when isomerized heavy diesel product 95 is passed through second fractionator 32 to remove most of the light hydrocarbons formed during isomerization from diesel product 95 to form the flashed isomerized heavy diesel product 98, flashed isomerized heavy diesel product 98 can be recycled to isomerization reactor 30. It may be desirable to operate isomerization reactor 30 at a lower conversion (such as for example by lowering the temperature) in isomerization reactor 30, so as to minimize hydrocracking in said reactor 30. Because the conversion can be reduced in isomerization reactor 30 (i.e., less isomerization would occur), recycling of a portion of isomerized heavy diesel product 95 or 98 to isomerization reactor 30 may be necessary to increase the isomerization yield.

Figure 2:
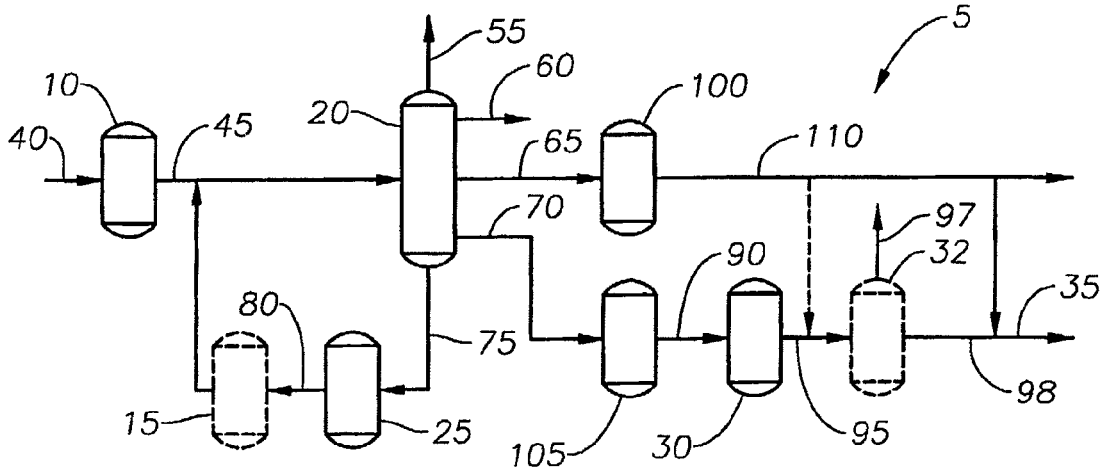
FIG. 2 illustrates a hydrocarbon production process having hydrotreaters downstream of a fractionator and a thermal cracker.

FIG. 2 illustrates an additional embodiment of the present invention in which light diesel 65 is hydrotreated in hydrotreating unit 100, and in which heavy diesel 70 is hydroprocessed in hydroprocessing unit 105.

The following describes an exemplary application of the present invention as embodied and illustrated in FIG. 2, which comprises substantially all of the elements of the above-discussed embodiments as illustrated in FIG. 1 and alternative embodiments thereof, with the additional elements discussed below. After hydrocarbon synthesis product 45 is produced in hydrocarbon synthesis reactor 10, it is fed to fractionator 20 where it is separated into distillate cuts, which include light fraction 55, naphtha 60, light diesel 65, heavy diesel 70, and waxy fraction 75.

Waxy fraction 75 is fed to thermal cracker 25 wherein at least a portion of waxy fraction 75 is cracked. Thermal cracker effluent 80 is recycled and co-fed with hydrocarbon synthesis product 45 to fractionator 20. In an alternative embodiment, thermal cracker effluent 80 leaves thermal cracker 25 and is fed to hydrotreating unit 15 (shown in dashed lines), in which thermal cracker effluent 80 is hydrotreated. In such an alternative embodiment, thermal cracker effluent 80 leaves hydrotreating unit 15 and is recycled to be fed concurrently with hydrocarbon synthesis product 45 (as shown) or separately (not shown) to fractionator 20. In other alternative embodiments, at least a fraction of thermal cracker effluent 80 leaves hydrotreating unit 15 and is combined with at least a portion of isomerized heavy diesel product 95 or 98 and/or at least a portion of light diesel to form diesel product 35.

After fractionation in fractionator 20, light diesel 65 and heavy diesel 70 are fed to hydrotreating unit 100 and hydroprocessing unit 105, respectively, in which light diesel 65 and heavy diesel 70 are hydrotreated and hydroprocessed, respectively. Hydrotreating unit 100 and hydroprocessing unit 105 each preferably comprise a hydrotreatment step that substantially converts substantially all unsaturated hydrocarbons present in light diesel 65 and heavy diesel 70 to paraffins. In addition, the hydrotreatment step can also convert oxygenates present in light diesel 65 and heavy diesel 70 to saturated hydrocarbons but can also allow a substantial amount of the oxygenates to remain unconverted. The hydrotreatment can take place over hydrotreating catalysts at temperatures from about 80° C. to about 400° C. (about 175 to about 750° F.). The hydrotreating catalysts comprise at least one of a Group VI metal, such as molybdenum and tungsten, and/or at least one of a Group VIII metal, such as nickel, palladium, platinum, ruthenium, iron, and cobalt. The nickel, palladium, platinum, tungsten, molybdenum, ruthenium, and combinations thereof are typically highly active catalysts, and the iron and cobalt are typically less active catalysts for hydrotreating.

Hydrotreating in hydrotreating unit 100 and hydroprocessing unit 105 can employ a mild hydrotreatment or an "ultra-low severity" hydrotreating as described above regarding hydrotreating unit 15 of FIG. 1. A mild hydrotreating step in hydrotreating unit 100 and hydroprocessing unit 105 may be performed over a hydrotreating catalyst comprising at least one metal selected from the group consisting of Ni, Pd, Pt, Mo, W, and Ru, preferably comprising Ni, Co, Mo, W or combinations thereof; more preferably comprising Ni, under mild conditions at temperatures above 350° F. (170° C.), preferably from 350° F. (170° C.) to about 750° F. (400° C.), more preferably from 360° F. to about 750° F. (180 to about 400° C.), with a hydrogen partial pressure in the hydrotreating unit/hydroprocessing unit outlet between about 100 psia and about 2,000 psia (690 to about 13,800 kPa). "Ultra-low severity" hydrotreating can take place with hydrotreating catalysts comprising at least one of the following metals: a metal from the group consisting of molybdenum (Mo), tungsten (W) and combination thereof, a metal from the group consisting of nickel (Ni), palladium (Pd), platinum (Pt), ruthenium (Ru), iron (Fe), cobalt (Co) and combinations thereof. Highly active catalysts, such as those comprising Ni, Pd, Pt, W, Mo, Ru or combinations thereof, are preferably operated at relatively low temperatures (to maintain "ultra-low severity" hydrotreating conditions) between about 180° F. and about 480° F. (about 80 to about 250° C.), more preferably between about 180° F. and about 350° F. (about 80 to about 180° C.), still more preferably between about 180° F. to about 300° F. (80 to about 150° C.). For such catalysts with lower hydrotreating activity (e.g., Co or Fe), a preferred temperature range for ultra-low severity hydrotreating is between about 350° F. and about 570° F. (about 180 to about 300° C.). Additionally, for ultra-low severity hydrotreating, the hydrogen partial pressure is between about 100 psia and about 1,000 psia (690 to about 6,900 kPa), more preferably between about 300 psia and about 500 psia (2,060 to about 3,450 kPa). The liquid hourly space velocity is preferably between 1 and 10 $hr^{-1}$, more preferably between 0.5 and 6 $hr^{-1}$, still more preferably between about 1 and about 5 $hr^{-1}$.

Preferably, at least a portion of light diesel 65 comprises linear hydrocarbons. More preferably, light diesel 65 comprises at least about 90 percent linear hydrocarbons. Preferably, at least a portion of heavy diesel 70 comprises linear hydrocarbons. More preferably, heavy diesel 70 comprises at least about 85 percent linear hydrocarbons, and still more preferably heavy diesel 70 comprises at least about 90 percent linear hydrocarbons. Still more preferably, light diesel 65 and heavy diesel 70 comprise mostly normal paraffins, have a high cetane number (i.e., greater than 70), may have some oxygenates derived from FT synthesis (for instance, if an "ultra-low severity" hydrotreating step is used) to obtain an acceptable lubricity, and have a very low degree of isomerization. Most preferably, light diesel 65 and heavy diesel 70 comprise at least 90 percent normal paraffins. Light diesel 65 can comprise branched hydrocarbons. Preferably, light diesel 65 comprises less than 10 percent branched hydrocarbons.

Hydrotreating of light diesel 65 produces hydrotreated light diesel 110. Preferably, at least a portion of hydrotreated light diesel 110 comprises linear hydrocarbons. More preferably, hydrotreated light diesel 110 comprises at least about 90 percent linear hydrocarbons (most preferably at least about 95 percent linear hydrocarbons). Hydrotreated light diesel 110 can comprise branched hydrocarbons, preferably less than 10 percent branched hydrocarbons. Still more preferably, hydrotreated light diesel 110 comprises mostly normal paraffins, has a high cetane number (i.e., greater than 70), may have some oxygenates derived from FT synthesis (for instance, if an "ultra-low severity" hydrotreating step is used) to obtain an acceptable lubricity, and has a very low degree of isomerization. Hydroprocessing of heavy diesel 70 produces hydroprocessed heavy diesel 90. Preferably, at least a portion of hydroprocessed heavy diesel 90 comprises linear hydrocarbons. More preferably, hydroprocessed heavy diesel 90 comprises at least about 60 percent linear hydrocarbons. If hydroprocessing unit 105 comprises hydrotreatment, hydroprocessed heavy diesel 90 preferably comprises at least about 80 percent linear paraffins.

In alternative embodiments, hydroprocessing in hydroprocessing unit 105 can further comprise hydrocracking heavy diesel 70. Preferably, the hydrocracking in hydroprocessing unit 105 takes place over a bi-functional hydrocracking catalyst comprising a hydrogenation component and a cracking component (typically an acid component). The hydrogenation component may include Pt, Pd, Ni, Co, W, Mo, or combinations thereof. The hydrogenation component in the bi-functional hydrocracking catalyst preferably includes Pt, Pd, or combinations thereof. The cracking component for the hydrocracking catalyst in hydroprocessing unit 105 may be an amorphous cracking material and/or a zeolitic material. A preferred cracking component comprises an amorphous silica-alumina; however, SAPO-type molecular sieves (such as SAPO-11; -31; -37; -41), Y-type zeolites, ZSM-type zeolites (such as ZSM-5; -11; -48), SSz-32 zeolite, and dealuminated zeolites may also be used. The cracking component may support the hydrogenation component; however, the catalyst may comprise a binder, which supports both hydrogenation and cracking components. The hydrocracking conditions for hydrocracking in hydroprocessing unit 105 are preferably at a temperature of about 550° F. to about 750° F. (260 to about 400° C.) and at a pressure of about 500 psig to about 1,500 psig (3,550 to about 10,440 kPa), an overall hydrogen consumption of 100-2,000 standard cubic feet per barrel of hydrocarbon feed (scf $H_2$/bbl HC) or 17-360 STP $m^3$ $H_2/m^3$ HC feed, preferably 200-1,000 scf $H_2$/bbl HC, using a liquid hourly space velocity based on the hydrocarbon feedstock of about 0.1 to about 10 $hr^{-1}$, preferably between 0.25 to 5 $hr^{-1}$. If hydroprocessing unit 105 comprises hydrocracking, hydroprocessed heavy diesel 90 preferably comprises mostly linear paraffins but may also comprise some isoparaffins.

Hydroprocessed heavy diesel 90 is fed to isomerization reactor 30 for hydroisomerization to obtain isomerized heavy diesel product 95 comprising branched hydrocarbons. Isomerized heavy diesel product 95 preferably comprises branched paraffins also called isoparaffins. Diesel product 35 can be formed by using at least a portion of isomerized heavy diesel product 95 "as is." In an alternative embodiment, since isomerization in isomerization reactor 30 can create some light hydrocarbons with a number of carbon atoms equal or less than 9 ($C_{9-}$), at least a portion of isomerized heavy diesel product 95 can be fed to a secondary fractionator 32 so as to remove those produced light hydrocarbons from the diesel-range product, i.e., to form a light fraction comprising mainly $C_{9-}$ hydrocarbons, and a isomerized heavy diesel comprising primarily $C_{10}$-$C_{25}$ hydrocarbons with at least 30 percent of the $C_{18}$-$C_{25}$ hydrocarbons being branched. At least a portion of (or all of) isomerized heavy diesel product 95 or at least a portion of, or all of, isomerized heavy diesel can be combined with at least a portion of hydrotreated light diesel 110 to form diesel product 35. Preferably, diesel product 35 comprises a combination of at least a portion of isomerized heavy diesel product 95 and at least a portion of hydrotreated light diesel 110. In alternate embodiments, diesel product 35 comprises a combination of at least a portion of the isomerized heavy diesel and at least a portion of hydrotreated light diesel 110. In yet another alternate embodiment, diesel product 35 comprises a combination of at least a portion of the isomerized heavy diesel, at least a portion of isomerized heavy diesel product 95, and at least a portion of hydrotreated light diesel 110. In alternative embodiments, although less preferred (not illustrated), diesel product 35 comprises isomerized heavy diesel product 95, fractionated isomerized heavy diesel fraction, or hydrotreated light diesel 110.

Naphtha 60 comprises primarily linear hydrocarbons and comprises primarily about $C_5$ to $C_9$ hydrocarbons, preferably $C_6$ to $C_{11}$ hydrocarbons. Preferably, 80 percent of naphtha 60 is linear hydrocarbons. Naphtha 60 can be characterized by a 5% boiling point between about 70° F. and 90° F. and a 95% boiling point less than about 350° F. The linear hydrocarbons can include any linear hydrocarbons, preferably normal alkanes, normal alkenes, or mixtures thereof, and preferably at least about 80 percent normal alkanes. In other alternative embodiments (not illustrated), naphtha 60 can be hydrotreated under similar conditions as hydrotreating unit 15 so as to convert substantially all of the olefins to their corresponding paraffins. Such highly linear hydrotreated naphtha is preferable for downstream uses such as steam cracker feed for the production of olefins (i.e., propylene, ethylene), as a source of solvents, and the like. It is also envisioned that at least a portion (or substantially all of) one light fraction comprising mainly $C_5$-$C_8$ hydrocarbons obtained from the optional second fractionator 32 located downstream to isomerization reactor 30 may be combined with naphtha 60 to increase the degree of branching in hydrocarbons of the resulting naphtha blend.

In other alternative embodiments of FIGS. 1 and 2, not all of thermal cracker effluent 80 is recycled and fed to fractionator 20. In such alternative embodiments, any desired portion of thermal cracker effluent 80 can be separated and not recycled. For instance, linear alpha olefins from thermal cracker effluent 80 can be separated and not recycled to fractionator 20. In other instances (not illustrated), thermal cracker effluent 80 can be fractionated into a light thermal cracker fraction and a heavy thermal cracker fraction, wherein the heavy thermal cracker fraction can be hydrotreated and the light thermal cracker fraction can comprise olefins and not be hydrotreated.

It is to be understood that the present invention is not limited to hydrocarbon production process 5 producing diesel product 35. In alternative embodiments of FIGS. 1 and 2, hydrocarbon production process 5 produces a synthetic middle distillate suitable for use as a fuel or fuel blend instead of diesel product 35. Suitable synthetic middle distillates other than diesel include the products commercially known as kerosene, jet fuel, furnace oil, home heating oil, range oil, stove oil, gas oil, heating oil, engine distillates and Nos. 1, 2, and 3 fuel oils. For example, hydrocarbon production process 5 can produce a jet fuel product rather than diesel product 35, wherein distillates 65 and 70 in FIG. 1 represent a light jet fuel cut and a heavy jet fuel cut, respectively. Alternatively, hydrocarbon production process 5 can produce a heating oil product rather than diesel product 35, wherein distillates 65 and 70 in FIG. 1 represent a light heating oil and a heavy heating oil, respectively. Alternative embodiments relate to a synthetic middle distillate suitable for use as a fuel or fuel blend, said synthetic middle distillate comprising at least two fractions: a light fraction characterized by a 5% boiling point less than about 360° F. and a 95% boiling point between about 500° F. and 550° F., wherein said light fraction has at least about 90 percent linear hydrocarbons; and a heavy fraction characterized by a 5% boiling point between about 500° F. and 550° F. and a 95% boiling point greater than about 630° F., wherein said heavy fraction has at least about 30 percent branched hydrocarbons. Preferably, the light fraction comprises not more than about 10 percent branched hydrocarbons. Alternatively, the heavy fraction has at least about 40 percent branched hydrocarbons and further comprises linear hydrocarbons. Said synthetic middle distillate preferably comprises about $C_{10}$-$C_{22}$ hydrocarbons. The linear hydrocarbons in the synthetic middle distillate can be provided by at least a fraction of a hydrotreated Fischer-Tropsch synthesis product stream and by at least a fraction of a hydrotreated thermally-cracked Fischer-Tropsch synthesis waxy product stream. The synthetic middle distillate comprises an amount of the heavy fraction sufficient to improve at least one cold-flow property of the synthetic middle distillate selected from the group consisting of pour point, cloud point and cold filter plugging point.

In other alternative embodiments of FIGS. 1 and 2, the synthetic middle distillate suitable for use as a fuel or fuel blend comprises at least two fractions: a light hydrocarbon fraction comprising between about 25 and about 40 percent by volume of the most volatile hydrocarbons in the synthetic middle distillate, wherein said light fraction comprises less than 10 percent of branched hydrocarbons; and a heavy hydrocarbon fraction comprising between about 10 and about 40 percent by volume of the least volatile hydrocarbons in the synthetic middle distillate, wherein said heavy fraction includes at least about 30 percent branched hydrocarbons. It is to be understood that the "most volatile" hydrocarbons refer to the hydrocarbons having the lowest boiling point, and the "least volatile" hydrocarbons refer to the hydrocarbons having the highest boiling point. Other embodiments include the heavy fraction having at least about 40 percent branched hydrocarbons. Further embodiments include the light fraction having at least about 80% linear hydrocarbons, preferably at least about 90% linear hydrocarbons. The light fraction can be characterized by a 5% boiling point less than about 360° F. and a 95% boiling point between about 425° F. and 475° F.; while the heavy fraction is characterized by a 5% boiling point between about 525° F. and 575° F. and a 95% boiling point greater than about 630° F. Alternatively, the light fraction is characterized by a 5% boiling point less than about 300° F. and a 95% boiling point between about 350° F. and 400° F.; while the heavy fraction is characterized by a 5% boiling point between about 425° F. and 450° F. and a 95% boiling point greater between about 450° F. and about 550° F. The synthetic middle distillate preferably is a diesel fuel or a jet fuel. Preferably, the synthetic middle distillate is a diesel fuel characterized by a 5% boiling point between about 340° F. and about 360° F. and a 95% boiling point between about 620° F. and about 640° F. Alternatively, the synthetic middle distillate is a jet fuel characterized by an initial boiling point of about 250° F. and a final boiling point between about 475° F. and about 550° F.

The above discussion is meant to be illustrative of the principles and various embodiments of the present invention. Numerous variations and modifications will become apparent to those skilled in the art once the above disclosure is fully appreciated.

What is claimed is:

1. A process for producing a synthetic diesel, the process comprising:

(A) feeding a syngas to a hydrocarbon synthesis reactor, wherein at least a portion of the syngas is reacted to generate a hydrocarbon synthesis product comprising $C_{5+}$ hydrocarbons;

(B) hydrotreating a hydrocarbon feed comprising the hydrocarbon synthesis product to provide a hydrotreated hydrocarbon stream;

(C) fractionating a fractionator feedstream comprising the hydrotreated hydrocarbon stream to produce a light diesel distillate, a heavy diesel distillate, and a waxy fraction, said light diesel distillate comprising less than 10 wt % branched hydrocarbons;

(D) thermally cracking at least a portion of the waxy fraction to produce a thermal cracker effluent;

(E) hydrotreating at least a portion or a fraction of the thermal cracker effluent to form a hydrotreated thermal cracker product; and (F) isomerizing at least a portion of the heavy diesel distillate to produce an isomerized heavy diesel product comprising at least 30% branched hydrocarbons;

wherein said synthetic diesel comprises a combination of at least a portion or a fraction of said isomerized heavy diesel product from step (F) and at least a portion of said light diesel distillate from step (C), wherein the process is carried out without substantially increasing the branching of hydrocarbon components of the at least said portion of said light diesel distillate from step (C).

2. The process of claim 1, wherein the hydrocarbon synthesis reactor comprises a Fischer-Tropsch reactor.

3. The process of claim 1, wherein hydrotreating in step (B) comprises temperatures between about 80° C. and about 400° C.

4. The process of claim 1, wherein hydrotreating in steps (B) and (E) comprises temperatures between about 80° C. and about 250° C.

5. The process of claim 1, wherein hydrotreating in steps (B) and (E) are performed in different hydrotreaters.

6. The process of claim 1, wherein hydrotreating in steps (B) and (E) are performed in the same hydrotreater.

7. The process of claim 6, further comprising recycling at least a portion of or at least a fraction of the thermal cracker effluent to step (B).

8. The process of claim 1, wherein step (C) further produces a naphtha distillate.

9. The process of claim 1, wherein step (C) further produces a jet fuel.

10. The process of claim 8, wherein the naphtha distillate comprises at least 90 percent linear hydrocarbons.

11. The process of claim 1, wherein the light diesel distillate comprises $C_{10}$-$C_{16}$ hydrocarbons, and the heavy diesel distillate comprises $C_{17}$-$C_{23}$ hydrocarbons.

12. The process of claim 1, wherein the light diesel distillate is characterized by a 5% boiling point less than about 360° F. and a 95% boiling point between about 500° F. and about 550° F., and the heavy diesel distillate is characterized by a 5% boiling point between about 500° F. and 55020 F. and a 95% boiling point greater than about 63020 F.

13. The process of claim 1, wherein the thermal cracking occurs between about 380° C. and about 700° C.

14. The process of claim 1, wherein the thermal cracking occurs between about 380° C. and about 550° C.

15. The process of claim 1, wherein isomerizing the heavy diesel distillate occurs at temperatures between about 180° C. and about 380° C.

16. The process of claim 1, wherein step (D) further comprises, before step (E) is performed and after the cracking step in step (D) is performed, fractionating the thermal cracker effluent into a light thermally cracked fraction and a heavy thermally cracked fraction; wherein step (E) comprises hydrotreating said heavy thermally cracked fraction; and further wherein the light thermally cracked fraction comprises olefins and is not hydrotreated.

17. The process of claim 1, further comprising feeding the hydrotreated thermal cracker product of step (E) to the fractionating step (C).

18. The process of claim 1, further comprising forming said synthetic diesel by blending at least a portion of the light diesel distillate and at least a portion of the isomerized heavy diesel product.

19. The process of claim 18, wherein the synthetic diesel further comprises at least a fraction of the hydrotreated thermal cracker product.

20. The process of claim 1, wherein the synthetic diesel comprises $C_{10}$-$C_{17}$ hydrocarbons having at least about 80 percent linear hydrocarbons.

21. The process of claim 1, wherein the synthetic diesel comprises $C_{17}$-$C_{23}$ hydrocarbons having at least about 30 percent branched hydrocarbons.

22. The process of claim 1, wherein the synthetic diesel comprises $C_{17}$-$C_{23}$ hydrocarbons having at least about 40 percent branched hydrocarbons.

23. A process for producing diesel, the process comprising:

(A) feeding a syngas to a hydrocarbon synthesis reactor, wherein at least a portion of the syngas is reacted to generate a hydrocarbon synthesis product comprising $C_5$+ hydrocarbons;

(B) providing a fractionator feed comprising the hydrocarbon synthesis product;

(C) separating the fractionator feed in a fractionator to produce at least a light diesel distillate, a heavy diesel distillate, and a waxy fraction;

(D) cracking in a thermal cracker at least a portion of the waxy fraction to produce a thermally-cracked effluent;

(E) hydrotreating at least a portion of or at least a fraction of the thermally-cracked effluent to form a hydrotreated thermally-cracked product;

(F) hydrotreating the light diesel distillate to produce a hydrotreated light diesel distillate, said hydroteated light diesel distillate comprising less than 10 wt % branched hydrocarbons;

(G) optionally, hydroprocessing the heavy diesel distillate; and (H) isomerizing the heavy diesel distillate to produce an isomerized effluent comprising at least 30% branched hydrocarbons, wherein the diesel is formed by combining at least a portion of the hydrotreated light diesel distillate, at least a portion or a fraction of the hydrotreated thermally-cracked product and at least a portion or fraction of the isomerized effluent, wherein the process is carried out without substantially increasing the branching of hydrocarbon components of the at least said portion of said hydrotreated light diesel distillate.

24. The process of claim 23, wherein the hydrocarbon synthesis reactor comprises a Fischer-Tropsch reactor.

25. The process of claim 23, wherein step (C) further produces a naphtha distillate comprising more than 80% linear hydrocarbons.

26. The process of claim 23 wherein step (E) comprises hydrotreating at least a portion of the thermally-cracked effluent of step (D).

27. The process of claim 23, wherein the light diesel distillate comprises $C_{10}$-$C_{16}$ hydrocarbons, and the heavy diesel distillate comprises $C_{17}$-$C_{23}$ hydrocarbons.

28. The process of claim 23, wherein the cracking occurs between about 380° C. and about 700° C.

29. The process of claim 23, wherein the cracking occurs between about 380° C. and about 550° C.

30. The process of claim 23, wherein hydroprocessing in step (G) comprises hydrotreating the heavy diesel distillate.

31. The process of claim 30, wherein hydrotreating comprises temperatures between about 170° C. and about 400° C.

32. The process of claim 30, wherein hydrotreating comprises temperatures between about 80° C. and about 250° C.

33. The process of claim 23, wherein isomerizing the heavy diesel distillate occurs at temperatures between about 180° C. and about 380° C.

34. The process of claim 23, wherein the diesel comprises a light fraction comprising between about 25 and about 40 percent by volume of the most volatile hydrocarbons in the diesel, said light fraction comprising less than 10% of branched hydrocarbons.

35. The process of claim 34, wherein the light fraction has at least about 90 percent linear hydrocarbons.

36. The process of claim 35, wherein the diesel comprises a heavy fraction comprising between about 10 and about 40 percent by volume of the least volatile hydrocarbons in the diesel, said heavy fraction having at least about 30 percent branched hydrocarbons.

37. The process of claim 23, wherein the diesel comprises a light fraction characterized by a 5% boiling point less than about 360° F. and a 95% boiling point between about 425° F. and 475° F., and wherein said light fraction has at least about 80 percent linear hydrocarbons.

38. The process of claim 23, wherein the diesel comprises $C_{17}$-$C_{23}$ hydrocarbons having at least about 30 percent branched hydrocarbons.

39. The process of claim 38, wherein the diesel further comprises $C_{17}$-$C_{23}$ hydrocarbons having at least about 40 percent branched hydrocarbons.

40. The process of claim 23, wherein the diesel comprises a heavy fraction characterized by a 5% boiling point between about 500° F. and 550° F. and a 95% boiling point greater than about 630° F., and wherein said heavy fraction has at least about 30 percent branched hydrocarbons.

41. The process of claim 23, further comprising (I) fractionating said isomerized heavy diesel product in a secondary fractionator to remove $C_{9-}$ hydrocarbons and to form a flashed isomerized heavy diesel fraction, and further wherein said synthetic diesel comprises a combination of at least a portion of said flashed isomerized heavy diesel fraction from said step (I) and at least a portion of said light diesel distillate from step (C).

42. The process of claim 23, wherein said light diesel distillate comprises more than 70% normal paraffins.

43. The process of claim 23, wherein said light diesel distillate comprises less than 5 wt % branched hydrocarbons.

44. The process of claim 23, wherein said synthetic diesel comprises $C_{10}$-$C_{22}$ hydrocarbons, said synthetic diesel comprising at least two fractions:

a light fraction characterized by a 5% boiling point less than about 360° F. and a 95% boiling point between about 500° F. and 550° F., wherein said light fraction has at least about 90 percent linear hydrocarbons; and a heavy fraction characterized by a 5% boiling point between about 500° F. and 550° F. and a 95% boiling point greater than about 630° F., wherein said heavy fraction has at least about 30 percent branched hydrocarbons.

45. The process of claim 23, wherein said synthetic diesel comprises $C_{10}$-$C_{16}$ hydrocarbons containing at least about 80 percent linear paraffins.

46. The process of claim 1, wherein said light diesel distillate comprises more than 70% normal paraffins.

47. The process of claim 1, wherein said light diesel distillate comprises less than 5 wt % branched hydrocarbons.

48. The process of claim 1, wherein said synthetic diesel comprises $C_{17}$-$C_{23}$ hydrocarbons containing at least about 30 percent branched hydrocarbons.

49. The process of claim 1, wherein said synthetic diesel comprises $C_{10}$-$C_{16}$ hydrocarbons containing at least about 80 percent linear paraffins.

50. The process of claim 1, wherein said synthetic diesel comprises $C_{10}$-$C_{22}$ hydrocarbons, said synthetic diesel comprising at least two fractions:

a light fraction characterized by a 5% boiling point less than about 360° F. and a 95% boiling point between about 500° F. and 550° F., wherein said light fraction has at least about 90 percent linear hydrocarbons; and a heavy fraction characterized by a 5% boiling point between about 500° F. and 550° F. and a 95% boiling point greater than about 630° F., wherein said heavy fraction has at least about 30 percent branched hydrocarbons.

51. The process of claim 1, further comprising (G) fractionating said isomerized heavy diesel product in a secondary fractionator to remove $C_{9-}$ hydrocarbons and to form a flashed isomerized heavy diesel fraction, and further wherein said synthetic diesel comprises a combination of at least a portion of said flashed isomerized heavy diesel fraction from said step (G) and at least a portion of said light diesel distillate from step (C).

52. A process for producing a synthetic diesel, the process comprising:

(A) feeding a syngas to a hydrocarbon synthesis reactor, wherein at least a portion of the syngas is reacted to generate a hydrocarbon synthesis product comprising $C_{5+}$ hydrocarbons;

(B) hydrotreating a hydrocarbon feed comprising the hydrocarbon synthesis product to provide a hydrotreated hydrocarbon stream;

(C) concurrently fractionating the hydrotreated hydrocarbon stream from step (B) and a hydrotreated thermally cracked product from step (F) in a fractionator to produce a light diesel distillate, a heavy diesel distillate, and a waxy fraction, said a light diesel distillate comprising no more than 10% branched hydrocarbons;

(E) thermally cracking at least a portion of the waxy fraction to produce a thermally cracked effluent;

(F) hydrotreating at least a portion or a fraction of the thermally cracked effluent to form a hydrotreated thermally cracked product;

(G) feeding said hydrotreated thermally cracked product to the fractionator used in step (C) in order for said hydrotreated thermally cracked product to be concurrently fractioned with said hydrotreated hydrocarbon stream in said fractionator;

(H) isomerizing at least a portion of the heavy diesel distillate from step (C) to produce an isomerized heavy diesel product, said isomerized heavy diesel comprising at least 30% branched hydrocarbons; and (I) forming said synthetic diesel by combining at least a portion of said light diesel distillate from step (C) and at least a portion or a fraction of said isomerized heavy diesel product from step (D), wherein the process is carried out without substantially increasing the branching of hydrocarbon components of the at least said portion of said light diesel distillate from step (C).

53. The process of claim 52, further comprising (J) fractionating said isomerized heavy diesel product in a secondary fractionator to remove $C_{9+}$ hydrocarbons and to form a flashed isomerized heavy diesel fraction, and further wherein said synthetic diesel comprises a combination of at least a portion of said flashed isomerized heavy diesel fraction from said step (J) and at least a portion of said light diesel distillate from step (C).

54. The process of claim 52, wherein said light diesel distillate comprises less than 5 wt % branched hydrocarbons.

55. The process of claim 52, wherein said light diesel distillate comprises more than 70% normal paraffins.

56. The process of claim 52, wherein said synthetic diesel comprises $C_{17}$-$C_{23}$ hydrocarbons containing at least about 30 percent branched hydrocarbons.

57. The process of claim 52, wherein said synthetic diesel comprises $C_{10}$-$C_{16}$ hydrocarbons containing at least about 80 percent linear paraffins.

* * * * *

UNITED STATES PATENT AND TRADEMARK OFFICE

CERTIFICATE OF CORRECTION

PATENT NO. : 7,345,211 B2
APPLICATION NO. : 10/886861
DATED : March 18, 2008
INVENTOR(S) : Rafael L. Espinoza et al.

It is certified that error appears in the above-identified patent and that said Letters Patent is hereby corrected as shown below:

Column 23,
Line 64, "55020 F." should be -- 550°F--.

Column 23,
Line 65, "63020 F." should be --630°F--.

Column 25,
Line 33, the number "35" should be --34--.

Column 28,
Line 3, "$C_{9+}$" should be --$C_{9-}$--.

Signed and Sealed this

Twenty-fourth Day of June, 2008

JON W. DUDAS
*Director of the United States Patent and Trademark Office*